US007025715B2

(12) United States Patent
Thiemann et al.

(10) Patent No.: US 7,025,715 B2
(45) Date of Patent: Apr. 11, 2006

(54) ROTARY-CUTTING DISK FOR A CENTRIFUGE FOR A CENTRIFUGE WITH A DUCT WALL CONTOURED IN A WAVE SHAPE

(75) Inventors: Ludger Thiemann, Oelde (DE); Volker Kassera, Starzach-Sulzau (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 10/798,264

(22) Filed: Mar. 12, 2004

(65) Prior Publication Data

US 2005/0003946 A1 Jan. 6, 2005

(30) Foreign Application Priority Data

Mar. 14, 2003 (DE) ..... 103 11 610

(51) Int. Cl.
*B04B 11/08* (2006.01)

(52) U.S. Cl. ..... 494/56

(58) Field of Classification Search ..... 494/56–59, 494/68–73

See application file for complete search history.

(56) References Cited

U.S. PATENT DOCUMENTS

| | | | | |
|---|---|---|---|---|
| 2,230,210 | A | 1/1941 | Brecour et al. | |
| 2,667,338 | A | 1/1954 | Hemfort | |
| 4,406,652 | A | 9/1983 | Nielsen | |
| 5,147,280 | A * | 9/1992 | Carlsson et al. | 494/56 |
| 5,160,311 | A * | 11/1992 | Inge et al. | 494/56 |
| 5,171,205 | A * | 12/1992 | Monkenbusch | 494/10 |
| 5,405,307 | A * | 4/1995 | Borgstrom et al. | 494/57 |
| 5,709,643 | A * | 1/1998 | Borgstrom et al. | 494/56 |
| 5,779,619 | A * | 7/1998 | Borgstrom et al. | 494/56 |
| 5,788,622 | A * | 8/1998 | Borgstrom et al. | 494/57 |
| 6,033,356 | A * | 3/2000 | Mackel et al. | 494/70 |
| 2004/0242395 | A1 * | 12/2004 | Thiemann | 494/56 |
| 2005/0003946 | A1 * | 1/2005 | Thiemann et al. | 494/56 |

FOREIGN PATENT DOCUMENTS

| | | | |
|---|---|---|---|
| DE | 3731229 | A1 * | 3/1989 |
| DE | 3936150 | A1 * | 6/1990 |
| DE | 199 12 773 | C1 | 12/2000 |
| EP | 0 892 680 | B1 | 7/2000 |
| EP | 0 756 523 | B1 | 6/2001 |
| GB | 987023 | | 3/1965 |
| WO | WO 88/07893 | | 10/1988 |
| WO | 95/29013 | A1 * | 11/1995 |
| WO | 03/024606 | A1 * | 3/2005 |
| WO | 1457263 | A2 * | 9/2005 |

* cited by examiner

*Primary Examiner*—Charles E. Cooley
(74) *Attorney, Agent, or Firm*—Barnes & Thornburg LLP

(57) ABSTRACT

The present disclosure relates to a rotary-cutting disk for a centrifuge. The rotary-cutting disk includes a disk-shaped base section adjoined by a tube-shaped section. Also included is at least one draining duct for a liquid phase in the base section, the draining duct extending at an acute angle from an inlet at an outer circumference of the base section and in a flow direction of a liquid phase. The at least one draining duct includes walls extending from the inlet to an outlet. At least one of the walls of the draining duct is at least partially or in sections contoured in a wave shape.

17 Claims, 2 Drawing Sheets

ROTARY-CUTTING DISK FOR A CENTRIFUGE FOR A CENTRIFUGE WITH A DUCT WALL CONTOURED IN A WAVE SHAPE

CROSS-REFERENCE

This non-provisional application claims benefit of and priority to German Application Number 103 11 610.9-23, filed Mar. 14, 2003, the disclosure of which is hereby incorporated by reference herein.

BACKGROUND

The present disclosure relates to a rotary-cutting disk having a draining duct for a liquid phase from a centrifuge, particularly from a separator.

Rotary-cutting disks—also called grippers—for centrifuges are known in many different embodiments such as from U.S. Patent Document U.S. Pat. No. 2,667,338. It is their object to drain a liquid phase from a centrifuge. Because of the type of their construction, many of the known solutions require high expenditures for their manufacture. Examples of this type are shown in European Patent Document EP 0 892 680 B 1, International Patent Document PCT/SE88/00181, U.S. Patent Document U.S. Pat. No. 4,406,652, U.S. Patent Document U.S. Pat. No. 2,230,210 or European Patent Document EP 0 756 523 B1.

British Patent Document GB 987023 and European Patent Document EP 0 756 523 are also mentioned with respect to the state of the art.

In practice, depending on the number of liquid phases to be drained, one or more of the rotary-cutting disks are arranged concentrically with respect to the axis of rotation of the centrifuge. Thus, it is known, for example, to place the rotary-cutting disks onto an intake tube of a separator. Furthermore, generally, the rotary-cutting disks have a disk-shaped or plate-shaped base section preferably adjoined by a tube-shaped section. They generally stand still relative to the rotating centrifuge. They have at least one draining duct by which liquid is again diverted from the inlet at the outer circumference of the disk-shaped section to the outlet in one or more axial draining duct/ducts in the tube-shaped section and, from there, the liquid is drained from the centrifuge. The at least one draining duct diverts the liquid in the disk-shaped section in the case of a known variant, for example, by slightly more than 90° from the flow direction at the outer circumference of the rotary-cutting disk in a curve toward the inside.

It is known to align the inlet of the draining duct at an acute angle with respect to the flow direction and to then lead it from the outer circumference of the rotary-cutting disk in a curve toward the inside.

This construction has been successful per se. However, the effect of cavitation has been a problem. It is desirable to reduce the effect of the cavitation and to also reduce stimulation of liquid-excited vibrations.

SUMMARY

Among other things, the present disclosure addresses the problems noted above.

The present disclosure relates to a rotary-cutting disk for a centrifuge. The rotary-cutting disk includes a disk-shaped base section adjoined by a tube-shaped section. Also included is at least one draining duct for a liquid phase in the base section, the draining duct extending at an acute angle from an inlet at an outer circumference of the base section and in a flow direction of the liquid phase, the flow direction starting in curved manner toward an inside of the disk. The at least one draining duct includes walls extending from the inlet to an outlet. At least one of the walls of the draining duct is at least partially or in sections contoured in a wave shape.

The wave shape is preferably formed by at least one wave contour which has at least one reversing point. The wave contours reduce the cavitation effect, particularly in a corner area, and additionally reduce the effect of liquid-excited vibrations. In this respect, it is desirable for a slope a of the wave contours to be smaller than 20° in their reversing points relative to a normal curve line K.

Other aspects of the present disclosure will become apparent from the following descriptions when considered in conjunction with the accompanying drawings.

DETAILED DESCRIPTION OF THE DRAWINGS

Figure 1:
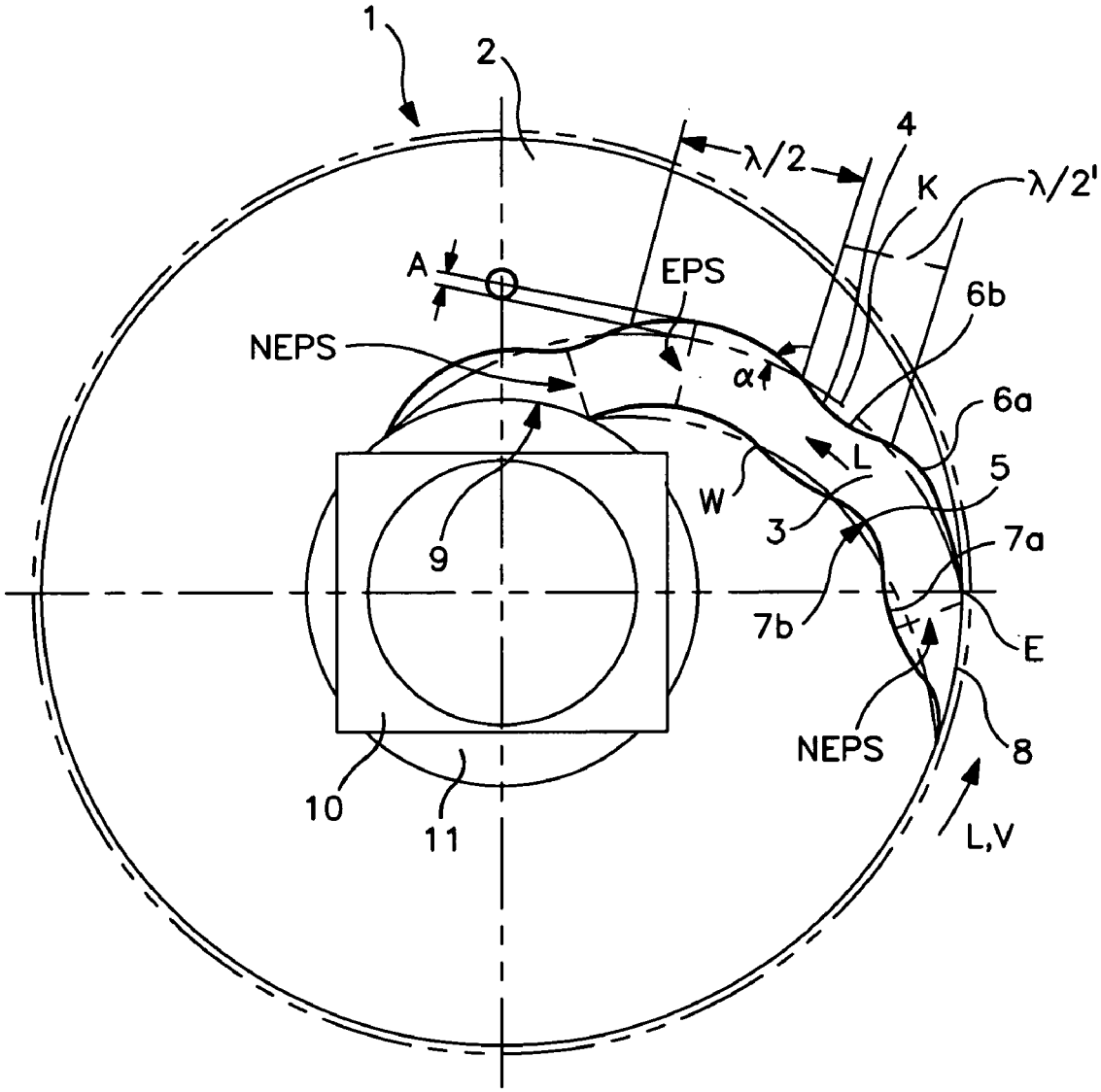
FIG. 1 is a top cross-sectional view of a rotary-cutting disk perpendicular to an axis of rotation, according to the principles of the present disclosure.
Figure 2:
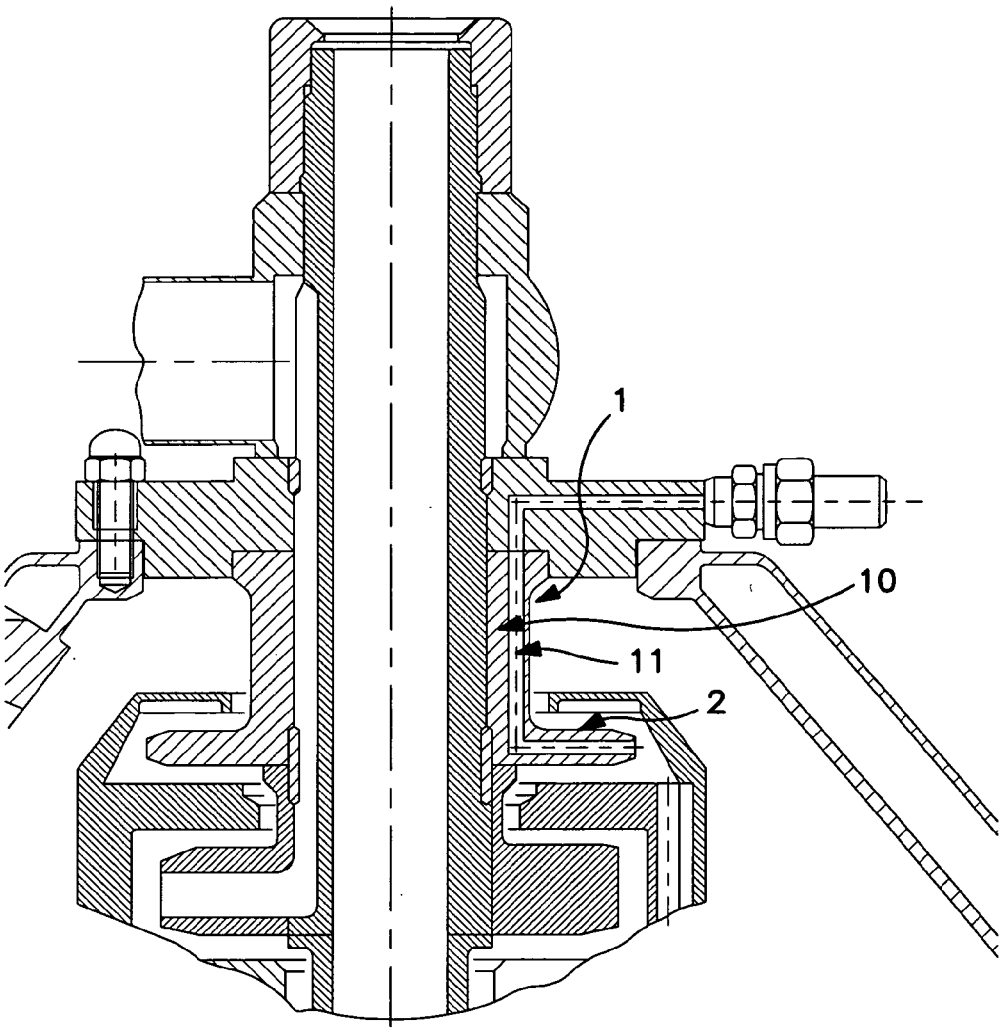
FIG. 2 is a cross-sectional view of a tube-shaped section having a ring duct, according to the principles of the present disclosure.

A rotary-cutting disk 1 has a usually axially relatively short, cylindrical, disk-shaped base section 2 which, perpendicular to a projection plane, is adjoined by a tube-shaped section 10 of a smaller diameter, as shown in FIGS. 1 and 2.

At least one draining duct 3, shown as the draining duct 3, for a liquid phase L is constructed in the disk-shaped section 2. Relative to a flow direction of the liquid L, an inlet 8 of the draining duct 3 is aligned at an acute angle. Then, the draining duct 3 extends from an outer circumference of the rotary-cutting disk 1 in a curve toward an inside of the disk 1. Here, an approximate deflection by slightly more than 90° takes place in the disk-shaped section 2 in a ring duct 11 around an intake tube. The ring duct 11 may be one or more ducts 1, for example, as shown in FIGS. 1 and 2.

For improving flow conditions and for reducing cavitation, at least a contour of one of walls 4, 5, is wave-shaped or is provided with at least one wave contour 6*a*, 6*b*, 7*a*, 7*b*. The walls 4, 5 may possibly be of a round or polygonal, particularly rectangular cross-section, completely or in sections.

A wave of a wavelength λ includes two half-wave contours 6*a* and 6*b* or 7*a* and 7*b*, which, relative to a normal curve line K, illustrated by a broken line on FIG. 1, which extends through reversing points W of the wave, are positively and negatively aligned and each has a length of λ/2.

Preferably, the walls 4, 5 have no sharp edges from the inlet 8 to the outlet 9. A function, for example, a sine function describing the contour of the walls 4, 5 can be differentiated at any point along the walls 4, 5, with the exception of the inlet 8 and the outlet 9, and with the exception of corner areas, for example, in the case of a cross-section which is not round and is rectangular.

A plurality of wave contours 6*a*, 6*b*. 7*a*, 7*b* may be provided. At least one of the walls 4, 5 should be equipped at least in sections with a half-wave contour 7*a*, particularly in the inlet 8 area and wall 5 which is situated opposite acute-angle corner area E.

With respect to their geometry, the wave contours 6*a*, 6*b*, 7*a*, 7*b* may, but do not have to follow a trigonometric formula, such as a sinusoidal curve. Their length λ/2 should be greater, particularly at least two times greater than its amplitude A.

According to another embodiment of the present disclosure, it is also conceivable that the wave contours 6*a*, 6*b*, 7*a*, 7*b* are mutually phase-shifted at the different walls 4, 5. In various areas of the walls 4, 5 of the draining duct 3, equiphase or non-equiphase (NEPS—see FIG. 1) wave contours 6*a*, 6*b*, 7*a*, 7*b* may therefore be constructed in the walls 4, 5 or, equiphase (EPS—see FIG. 1) wave contours 6*a*, 6*b*. 7*a*, 7*b* may be situated opposite one another, for example, such that a width of the draining duct 3 is constant, or, for example, opposite-phase wave contours 6*a*, 6*b*, 7*a*, 7*b* may also be formed.

According to another embodiment of the present disclosure, the wavelength λ may also change from the inlet 8 to the outlet 9; that is, increase or decrease continuously (see FIG. 1, λ/2 and λ/2'). In particular, this may further reduce undesirable vibration effects.

The slope a of the wave contours 6*a*, 6*b*, 7*a*, 7*b*, at their reversing points W, amounts to less than 20° relative to the reversing-point-free normal curve line K through the reversing points W.

The liquid L flows into the draining duct 3 at a velocity V. The wave contours 6*a*, 6*b*, 7*a*, 7*b* may reduce the cavitation effect, particularly in the corner area E.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A rotary-cutting disk for a centrifuge, comprising:

a disk-shaped base section adjoined by a tube-shaped section;

at least one draining duct for a liquid phase in the base section, the draining duct extending at an acute angle from an inlet at an outer circumference of the base section and in a flow direction of the liquid phase, the flow direction starting in a curved manner toward an inside of the disk;

the at least one draining duct having walls extending from the inlet to an outlet, and at least one of the walls of the draining duct being at least partially or in sections contoured in a wave shape.

2. The rotary-cutting disk according to claim 1, wherein the wave shape is formed by at least one wave contour having at least one reversing point.

3. The rotary-cutting disk according to claim 1, wherein a mathematical function describing a contour of at least one of the walls is differentiated at each point along that wall with the exception of the inlet and the outlet and with the exception of an angular corner area of the at least one draining duct.

4. The rotary-cutting disk according to claim 1, wherein at least one of the walls is provided at least in sections with a wave contours.

5. The rotary-cutting disk according to claim 1, wherein at least one of the walls is provided in sections with a wave contour at least over a first half of a path of the at least one draining duct.

6. The rotary-cutting disk according to claim 1, wherein wave contours are constructed on at least one of the walls according to a trigonometric formula.

7. The rotary-cutting disk according to claim 6, wherein a length λ/2 of the wave contours is greater than an amplitude A of the wave contours.

8. The rotary-cutting disk of claim 7, wherein the length λ/2 is at least two times greater than the amplitude A of the wave contours.

9. The rotary-cutting disk according to claim 1, wherein wave contours are constructed according to a sinusoidal curve.

10. The rotary-cutting disk according to claim 9, wherein a length λ/2 of the wave contours is greater than an amplitude A of the wave contours.

11. The rotary-cutting disk of claim 10, wherein the length λ/2 is at least two times greater than the amplitude A of the wave contours.

12. The rotary-cutting disk according to claim 1, wherein equiphase wave contours are constructed in different areas of at least one of the walls of the draining duct.

13. The rotary-cutting disk according to claim 1, wherein non-equiphase wave contours are constructed in different areas of at least one of the walls of the draining duct.

14. The rotary-cutting disk according to claim 1, wherein a length λ/2 of wave contours of at least one of the walls of the at least one draining duct changes from the inlet to the outlet.

15. The rotary-cutting disk according to claim 1, wherein a length λ/2 of wave contours of at least one of the walls of the at least one draining duct increases continuously from the inlet to the outlet.

16. The rotary-cutting disk according to claim 1, wherein wave contours are mutually phase-shifted at the walls of the at least one draining duct.

17. The rotary-cutting disk according to claim 1, wherein a slope α of wave contours of at least one of the walls of the at least one draining duct is smaller than 20° relative to a normal curve line K in reversing points of the wave contours.

* * * * *